US011199091B2

(12) United States Patent
Qin et al.

(10) Patent No.: US 11,199,091 B2
(45) Date of Patent: Dec. 14, 2021

(54) CAGEWAY CONNECTING DEVICE AND CONNECTING METHOD THEREOF

(71) Applicants: HEFEI DESIGN AND RESEARCH INSTITUTE OF COAL INDUSTRY CO., LTD., Hefei (CN); HEFEI UNIVERSITY, Hefei (CN); XUZHOU COAL MINE SAFETY EQUIPMENT MANUFACTURE CO., LTD., Xuzhou (CN)

(72) Inventors: Qiang Qin, Hefei (CN); Hongxin Yan, Hefei (CN); Changhua Hu, Xuzhou (CN); Qingyong Du, Xuzhou (CN); Jianguo Ding, Hefei (CN)

(73) Assignees: Hefei Design & Research Inst. Of Coal Industry Co., LTD., Hefei (CN); Hefei University, Hefei (CN); Xuzhou Coal Mine Safety Equipment Manufacture Co., LTD., Xuzhou (CN)

( * ) Notice: Subject to any disclaimer, the term of this patent is extended or adjusted under 35 U.S.C. 154(b) by 78 days.

(21) Appl. No.: 16/843,179

(22) Filed: Apr. 8, 2020

(65) Prior Publication Data

US 2020/0232321 A1 Jul. 23, 2020

Related U.S. Application Data

(63) Continuation of application No. PCT/CN2018/102668, filed on Aug. 28, 2018.

(30) Foreign Application Priority Data

Jul. 27, 2018 (CN) ..... 201810847168.4

(51) Int. Cl.
*B66B 19/00* (2006.01)
*E21D 7/02* (2006.01)
*B66B 7/02* (2006.01)

(52) U.S. Cl.
CPC ..... *E21D 7/02* (2013.01); *B66B 7/026* (2013.01); *B66B 19/002* (2013.01)

(58) Field of Classification Search
CPC ..... B66B 7/022; B66B 7/023; B66B 7/026; B66B 7/02; B66B 19/002; E21D 7/08
See application file for complete search history.

(56) References Cited

U.S. PATENT DOCUMENTS 4,079,817 A * 3/1978 Tosato ..... B66B 7/02 187/408
2005/0006184 A1* 1/2005 Valjus ..... B66B 7/021 187/408

(Continued)

*Primary Examiner* — Michael A Riegelman
(74) *Attorney, Agent, or Firm* — Hemisphere Law, PLLC; Zhigang Ma

(57) ABSTRACT

A cageway connecting device and connecting method thereof is invented, the device includes a connecting cageway, an upper cannula, a lower cannula, two first steel angles, a fixed block, a pin boss and a fixed pin. The connecting cageway is set between the upper cageway and the lower cageway. The upper cannula is fixed in the connecting cageway. The lower cannula is fixed in the connecting cageway. The two first steel angles are fixed on the connecting cageway. The fixed block is fixed on the upper cannula. The pin boss is fixed on the lower cageway. The fixed pin is passed through the first pin bore and inserted into the second pin bore. The invention improve the accuracy of the initial installation of the cageway and facilitate the replacement of the cageway. The first cageway beam is determined and controllable.

15 Claims, 4 Drawing Sheets

(56) References Cited

U.S. PATENT DOCUMENTS

| | | | | |
|---|---|---|---|---|
| 2012/0263554 | A1* | 10/2012 | Sanz Gamboa | B66B 7/026 411/81 |
| 2012/0312640 | A1* | 12/2012 | Bjorni | B66B 7/023 187/408 |
| 2013/0056310 | A1* | 3/2013 | Bjorni | B66B 7/026 187/359 |
| 2016/0083222 | A1* | 3/2016 | Fernandez | B66B 5/0087 187/406 |
| 2018/0009633 | A1* | 1/2018 | Fargo | B66B 11/0407 |
| 2018/0079624 | A1* | 3/2018 | Kirsch | B66B 7/024 |
| 2018/0170712 | A1* | 6/2018 | Fauconnet | B66B 7/026 |
| 2018/0297815 | A1* | 10/2018 | Kirsch | B66B 7/024 |
| 2019/0055108 | A1* | 2/2019 | Fauconnet | B33Y 80/00 |
| 2020/0115190 | A1* | 4/2020 | Xiong | B66B 7/02 |
| 2020/0232321 | A1* | 7/2020 | Qin | E21D 7/02 |
| 2021/0016994 | A1* | 1/2021 | Haag | B66B 19/002 |
| 2021/0016998 | A1* | 1/2021 | Haag | B66B 19/002 |
| 2021/0179388 | A1* | 6/2021 | Darnley, III | B66B 11/0226 |

* cited by examiner

CAGEWAY CONNECTING DEVICE AND CONNECTING METHOD THEREOF

FIELD OF THE INVENTION

The present invention relates to technical field of mining equipment technology, and more particularly to a cageway connecting device and connecting method thereof.

BACKGROUND OF THE INVENTION

In the vertical shaft hoisting system in the field of mine, when the hoisting container is running up and down, the roller lug on the hoisting container is required to guide the movement in the vertical direction of the cageway, so as to ensure that the hoisting container does not swing in the horizontal direction and ensure the safety of the hoisting system. At present, many cageways (about 12 meters each) made by cold-rolled square steel are used, one by one from the head to the bottom of the mine to form a complete cageway with a length of several hundred meters or more. Each cageway is connected with the first cageway beam through the first steel angle, and the first cageway beam is connected with the shaft again and again. However, there are some disadvantages in traditional cageway structure connection mode, and they are as follows.

(1) It is not easy to ensure the installation accuracy of the cageway. Because the installation accuracy of the cageway is adjusted by the cageway beam, once the cageway beam is fixed, the adjustment range of the cageway is very small, and the adjustment method is limited. In addition, two or more cageways are often fixed on one cageway beam, and the position of each cageway cannot be adjusted. There is extrusion relationship between adjacent cageways, which also has a negative impact on the installation accuracy.

(2) It is easy to cause deformation when the upper and lower cageways are squeezed. There are two ways to connect the upper and lower cageways, one is direct butt joint, which has less mutual interference between the upper and lower cageways, but there is dislocation between the cageways, which is very harmful to the overall quality improvement of the cageway, and many new mines are no longer used. The other way is to weld the positioning cannula at the end of the cageway, and directly insert the positioning cannula into another cageway. The upper and lower cageways of the two ways transfer forces to each other, and these forces are uncontrollable, especially when multiple cageways transfer forces together downward, which may cause deformation of the lower cageway beam and cageways.

(3) It is not conducive to the maintenance and adjustment of cageway. After the hoisting system runs for a period of time, the shaft wall will settle and deform, or the cageway beam and the cageways are damaged, so it is necessary to adjust the position of the cageway and the cageway beam. In the traditional structure, because the upper and lower cageways are squeezed together, it is difficult to adjust.

(4) It is not conducive to replace cageway. Take the replace connected by plug-in method as an example, multiple cageways are connected into one body. If one cageway is to be replaced, the cageway must be cut. When reinstalling another cageway, because the position cannula cannot be inserted, it can only be simply connected, and there is a great possibility of dislocation between cageways, thus reducing the quality of the overall cageway.

With the development of mining industry, higher and higher requirements are put forward for lifting height, load and speed. If the straightness, smoothness and flatness of the whole cageway cannot meet the technical requirements, the maintenance and repair conditions cannot be guaranteed, and the requirements for high speed and heavy load of the lifting system cannot be achieved. Therefore, it is necessary to design a kind of connecting device and connecting method of the cageways to solve the above contradictions.

SUMMARY OF THE INVENTION

Therefore, the object of the present invention is to provide a cageway connecting device, which can connect multiple cageways conveniently.

The another object of the present invention provides a connecting method of a cageway connecting device, which is used to connect the above cageway connecting device.

The present invention provides a cageway connecting device, for connecting an upper cageway and a lower cageway; a notch being set at the top end of the lower cageway; the cageway connecting device includes:

a connecting cageway, which is set between the upper cageway and the lower cageway;

an upper cannula, the bottom end of the upper cannula is fixed in the top end of the connecting cageway, the top end of the upper cannula is inserted into the bottom end of the upper cageway and conformed on the inner wall of the bottom end of the upper cageway;

a lower cannula, the top end of the lower cannula is fixed in the bottom end of the connecting cageway, the bottom end of the lower cannula is inserted into the top end of the lower cageway and conformed on the inner wall of the top end of the lower cageway;

two first steel angles symmetrically arranged, which are fixed on the same side of the connecting cageway and set from top to bottom;

a fixed block, which is fixed on the outside of the lower cannula, and a first pin bore downward is set in the fixed block;

a pin boss, which is fixed on the outside of the top end of the lower cageway, and located below the notch; a second pin bore coaxial with the first pin bore is set in the pin boss; and a fixed pin, for fixing the fixed block and the pin boss; the bottom end of the fixed pin is passed through the first pin bore and inserted into the second pin bore.

In the cageway connecting device of the present invention, a first cageway beam is set between the two first steel angles, and the two first steel angles are fixed on the top and bottom ends of the first cageway beam respectively by a plurality of fasteners.

In the cageway connecting device of the present invention, each first steel angle is fixed on the first cageway beam by two fasteners symmetrical about the first cageway beam.

In the cageway connecting device of the present invention, the fasteners are bolts.

In the cageway connecting device of the present invention, a shim is set between the first cageway beam and the first steel angle located below the first cageway beam.

In the cageway connecting device of the present invention, further includes:

two ribs, corresponding to the two first steel angles respectively; each rib is fixed on the bending surface of the corresponding first steel angle.

In the cageway connecting device of the present invention, the fixed pin is a taper pin or a cylindrical pin.

In the cageway connecting device of the present invention, further includes:

an assist mechanism, includes two second steel angles symmetrically arranged; the two second steel angles are fixed on the same side of the upper cageway or the lower cageway and set from top to bottom.

In the cageway connecting device of the present invention, a second cageway beam is set between the two second steel angles, and the two second steel angles are fixed on the top and bottom ends of the second cageway beam respectively.

In the cageway connecting device of the present invention, the assist mechanism further includes two backing boards corresponding to the two second steel angles; each backing board is set between the corresponding second steel angle and the upper cageway or the lower cageway.

In the cageway connecting device of the present invention, the cross section of the connecting cageway is the same as that of the upper cageway and the lower cageway.

The present invention also provides a connecting method of a cageway connecting device, for connecting an upper cageway and a lower cageway; a notch is set at the top end of the lower cageway; the cageway connecting device includes:

a connecting cageway, which is set between the upper cageway and the lower cageway;

an upper cannula, the bottom end of the upper cannula is fixed in the top end of the connecting cageway, the top end of the upper cannula is inserted into the bottom end of the upper cageway and conformed on the inner wall of the bottom end of the upper cageway;

a lower cannula, the top end of the lower cannula is fixed in the bottom end of the connecting cageway, the bottom end of the lower cannula is inserted into the top end of the lower cageway and conformed on the inner wall of the top end of the lower cageway;

two first steel angles symmetrically arranged, which are fixed on the same side of the connecting cageway and set from top to bottom;

a fixed block, which is fixed on the outside of the lower cannula, and a first pin bore downward is set in the fixed block;

a pin boss, which is fixed on the outside of the top end of the lower cageway and located below the notch; a second pin bore coaxial with the first pin bore is set in the pin boss; and a fixed pin, for fixing the fixed block and the pin boss; the bottom end of the fixed pin is passed through the first pin bore and inserted into the second pin bore; the connecting method includes:

fixing the two first steel angles in the vertical direction, and putting the top end of the lower cageway on the bottom end of the lower cannula, then rotating the lower cageway to make the first pin bore and the second pin bore be coaxial;

passing the bottom end of the fixed pin through the first pin bore, then inserting the bottom end of the fixed pin into the second pin bore to make the pin boss and the fixed block be fixed; and putting the bottom end of the upper cageway on the top end of the upper cannula to make upper cageway be overlapped on the connecting cageway.

The present invention also provides a connecting method of a cageway connecting device, for connecting an upper cageway and a lower cageway; a notch is set at the top end of the lower cageway;

the cageway connecting device includes:

a connecting cageway, which is set between the upper cageway and the lower cageway;

an upper cannula, the bottom end of the upper cannula is fixed in the top end of the connecting cageway, the top end of the upper cannula is inserted into the bottom end of the upper cageway and conformed on the inner wall of the bottom end of the upper cageway;

a lower cannula, the top end of the lower cannula is fixed in the bottom end of the connecting cageway, the bottom end of the lower cannula is inserted into the top end of the lower cageway and conformed on the inner wall of the top end of the lower cageway;

two first steel angles symmetrically arranged, which are fixed on the same side of the connecting cageway and set from top to bottom; a first cageway beam is set between the two first steel angles, and the two first steel angles are fixed on the top and bottom ends of the first cageway beam respectively by a plurality of fasteners;

a fixed block, which is fixed on the outside of the lower cannula, and a first pin bore downward is set in the fixed block;

a pin boss, which is fixed on the outside of the top end of the lower cageway and located below the notch; a second pin bore coaxial with the first pin bore is set in the pin boss; and a fixed pin, for fixing the fixed block and the pin boss; the bottom end of the fixed pin is passed through the first pin bore and inserted into the second pin bore; the connecting method includes:

(1) pre assembling each cageway connecting device and the corresponding cageways;

(2) clamping the first steel angles of each cageway connecting device to the corresponding first cageway beam to make each cageway connecting device be fixed on the corresponding first cageway beam; and (3) first, putting the top end of the lower cageway on the bottom end of the lower cannula, then rotating the lower cageway to make the first pin bore and the second pin bore be coaxial; second, passing the bottom end of the fixed pin through the first pin bore, then inserting the bottom end of the fixed pin into the second pin bore to make the pin boss and the fixed block be fixed; third, putting the bottom end of the upper cageway on the top end of the upper cannula to make upper cageway be overlapped on the connecting cageway; the last, rotating the upper cageway, then fixing the upper cageway through another cageway connecting device above the upper cageway, and installing each cageway according to this step to complete the connection of each cageway.

In the connecting method of the present invention, in step (1), making one-to-one corresponding marks on each cageway connecting device and the corresponding cageways, and protecting the ends of the cageways.

In the connecting method of the present invention, in step (3), putting the top end of the lower cageway on the bottom end of the corresponding lower cannula by a bottom-up installation method.

Solution of the present invention, for solving the above problem, is that apply the cageway connecting device which can connect multiple cageways conveniently. Each cageway connecting device can connect one upper cageway and one lower cageway, so multiple cageways can be connected, and the notch is set at the top end of the lower cageway, so that the lower cageway is convenient to insert into the cageway connecting device. The two first steel angles can clamp the corresponding first cageway beam, so as to make each cageway connecting device be fixed on the corresponding first cageway beam, and further fix the upper cageway and the lower cageway. In this way, it is convenient to adjust the installation position of the cageway connecting device, and then adjust the installation position of the upper and lower cageways. The fixed block, the pin boss and the fixed pin can fix the cageway connecting device and the lower cageway to enhance the stability of the device and the lower cageway, and further the shim and ribs plate are able to strengthen the firmness and stability of the overall structure.

Moreover, the cageway connecting device of the present invention is independent of each cageway, and each cageway connecting device is set between the two cageways, therefore, the device can be installed and adjusted freely and accurately on the cageway beam. The position accuracy of the cageways is determined by multiple cageway connecting devices as a whole, which can improve the accuracy of the initial installation of the cageway and facilitate the replacement of the cageway. Furthermore, the connecting method of the present invention makes each first cageway beam bear the weight of the above cageway, so the first cageway beam is determined and controllable, and the deformation of the first cageway beams and the mutual extrusion of the cageways will not exist.

In addition, the assist mechanism further strengthens the stability of the upper cageway and the lower cageway, prevents the offset of each cageway, and further improves the stability of the connection of the cageways. The fixed pin can be a taper pin, its self-locking property is good, and the positioning accuracy is high, which is convenient for the installation of the cageway and the influence of multiple assembly and disassembly on the positioning accuracy is small. The fixed pin can be a cylindrical pin, the shear resistance between the upper cageway and the lower cageway can be strengthened, and the stability of the connection of the cageways can be improved.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

First Embodiment

Figure 1:
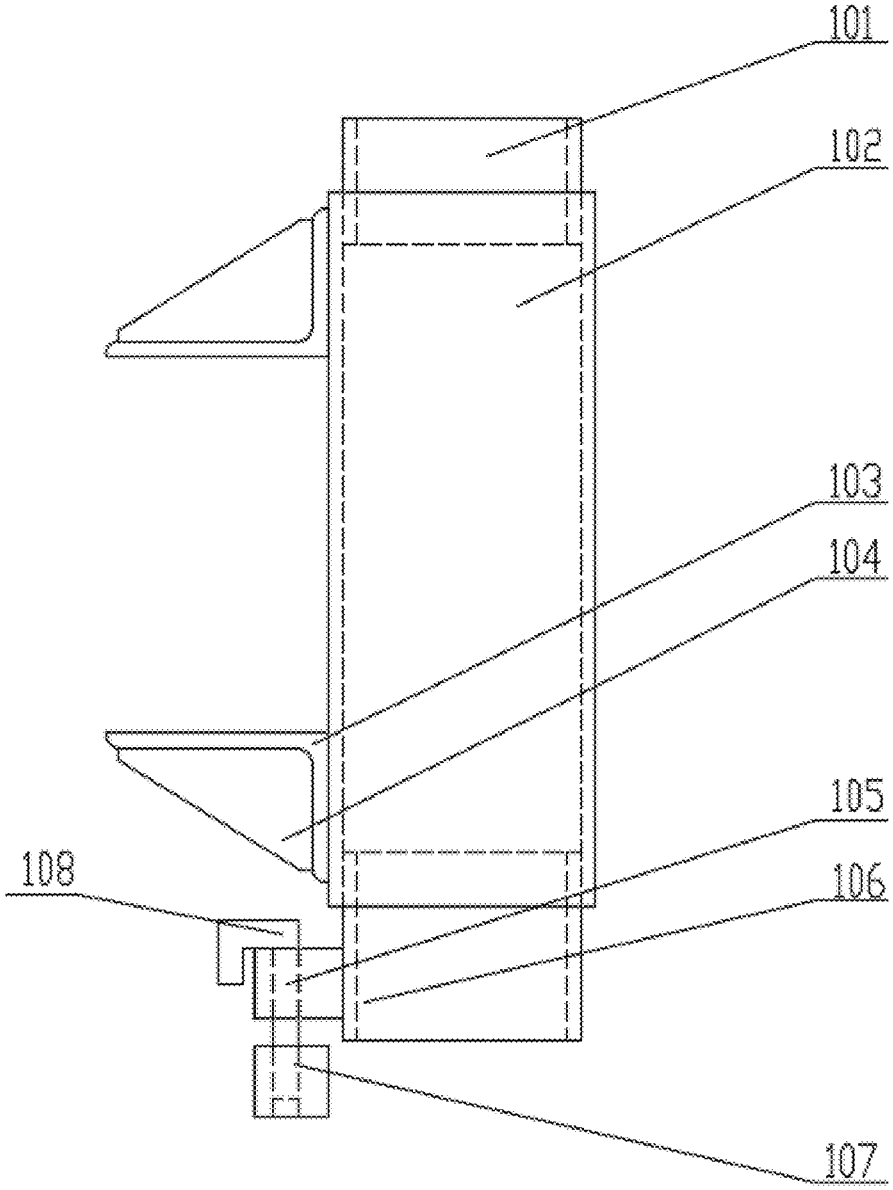
FIG. 1 is a structure diagram of the cageway connecting device, according to the first embodiment of the present invention.
Figure 2:
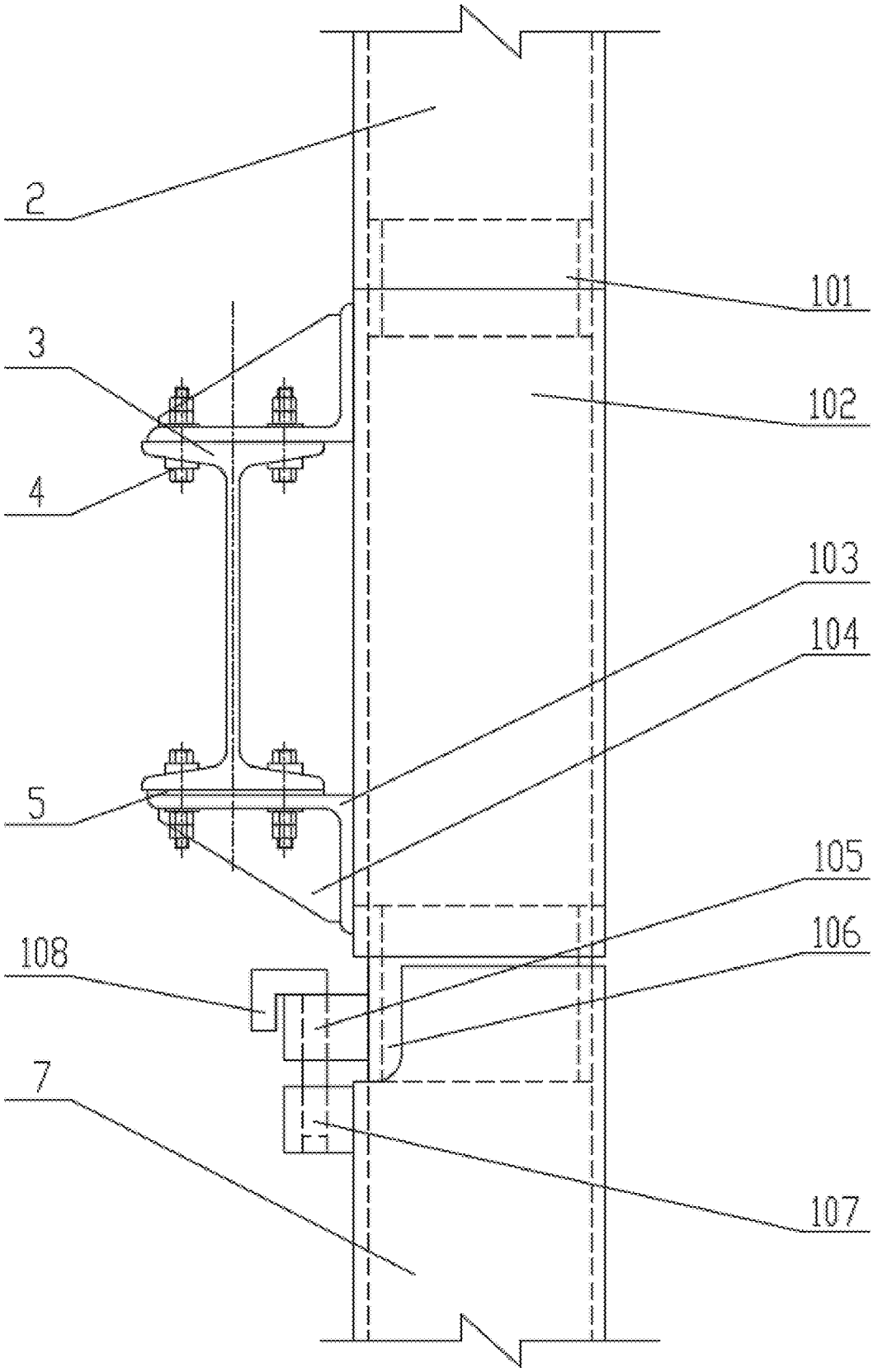
FIG. 2 is a connection diagram of the cageway connecting device, according to the first embodiment of the present invention.

Referring to FIGS. 1 and 2, a cageway connecting device is shown as an embodiment. The cageway connecting device of this embodiment is set between two cageways, and for the convenience of description, the two cageways are named upper cageway 2 and lower cageway 7, the device is used for connecting the upper cageway 2 and the lower cageway 7. The cageway connecting device includes a connecting cageway 102, an upper cannula 101, a lower cannula 106, two first steel angles 103, a fixed block 105, a pin boss 107, a fixed pin 108, and further includes two ribs 104. Wherein, if the cageway connecting device is separated separately, the guiding function and positioning function of the traditional cageway are respectively undertaken by each cageway and the corresponding cageway connecting device in the embodiment.

The connecting cageway 102 is set between the upper cageway 2 and the lower cageway 7, and the cross section of the connecting cageway 102 is the same as that of the upper cageway 2 and the lower cageway 7. That is to say, the connecting cageway 102 adopts the shortened cageway. The connecting cageway 102 is able to separate the upper cageway 2 and the lower cageway 7 to avoid direct connection between upper cageway 2 and the lower cageway 7, so as to avoid mutual extrusion between the upper cageway 2 and the lower cageway 7.

The bottom end of the upper cannula 101 is fixed in the top end of the connecting cageway 102, the top end of the upper cannula 101 is inserted into the bottom end of the upper cageway 2 and conformed on the inner wall of the bottom end of the upper cageway 2. The upper cannula 101 can connect the upper cageway 2 and the connecting cageway 102, and make the connection between the upper cageway 2 and the connecting cageway 102 more reliable, so as to reduce the connection deviation between the upper cageway 2 and the connecting cageway 102, and improve the connection accuracy of the cageways.

The top end of the lower cannula 106 is fixed in the bottom end of the connecting cageway 102, the bottom end of the lower cannula 106 is inserted into the top end of the lower cageway 7 and conformed on the inner wall of the top end of the lower cageway 7. The function of the lower cannula 106 is the same as that of the upper cannula 101, which can make the connection between the lower cageway 7 and the connecting cageway 102 more reliable, so as to reduce the connection deviation between the lower cageway 7 and the connecting cageway 102, and improve the connection accuracy of the cageways.

The two first steel angles 103 are arranged symmetrically, which is fixed on the same side of the connecting cageway 102 and set from top to bottom. A first cageway beam 3 is set between the two first steel angles 103, and the two first steel angles 103 are fixed on the top and bottom ends of the first cageway beam 3 respectively by a plurality of fasteners 4. Wherein, each first steel angle 103 is fixed on the first cageway beam 3 by two fasteners 4 symmetrical about the first cageway beam 3. In the embodiment, the fasteners 4 are bolts. The two first steel angles 103 can clamp the corresponding first cageway beam 3, so as to make each cageway connecting device be fixed on the corresponding first cageway beam 3, and further fix the upper cageway 2 and the lower cageway 7. In this way, it is convenient to adjust the installation position of the cageway connecting device, and then adjust the installation position of the upper and lower cageways. In some embodiments, a shim 5 is set between the first cageway beam 3 and the first steel angle 103 located below the first cageway beam 3.

The fixed block 105 is fixed on the outside of the lower cannula 106, and a first pin bore downward is set in the fixed block 105. The first pin bore can be a taper bore or a cylindrical bore, specific choice can be set according to the actual needs.

The pin boss 107 is fixed on the outside of the top end of the lower cageway 7, and located below the notch. A second pin bore coaxial with the first pin bore is set in the pin boss 107, the second pin bore can also be a taper bore or a cylindrical bore, but they should match each other. When the first pin bore and the second pin bore are both tapered, the taper shall be the same and a taper pin may be inserted into the first pin bore and the second pin bore. When the first pin bore and the second pin bore are both cylindrical bores, the radius of the cylindrical bore shall be the same. In this embodiment, the first pin bore and the second pin bore are both cylindrical bores.

The fixed pin 108 is used for fixing the fixed block 105 and the pin boss 107. The bottom end of the fixed pin 108 is passed through the first pin bore and inserted into the second pin bore. The fixed pin 108 can be a taper pin or a cylindrical pin, specific choice can be set according to the actual needs. In this embodiment, the fixed pin 108 is a cylindrical pin. In other embodiments, the fixed pin 108 is a taper pin, and the first pin bore and the second pin bore are both cylindrical bores.

The fixed block 105, the pin boss 107 and the fixed pin 108 are combined to form a fixing device of the upper cageway 2 and the lower cageway 7, so as to fix the two cageways and strengthen the stability of the connection between the cageway connecting device and the lower cageway 7.

The two ribs 104 are corresponding to the two first steel angles 103 respectively. Each rib 104 is fixed on the bending surface of the corresponding first steel angle 103, which is used to improve the stress stability of the first steel angle 103 and the firmness of the cageway connecting device.

In some embodiments, a notch being set at the top end of the lower cageway 7. In this way, it is convenient for the lower cageway 7 to be inserted into the cageway connecting device and the lower cageway 7 can be rotated to adjust the installation angle between the lower cageway 7 and the cageway connecting device.

As described above, the cageway connecting device can connect multiple cageways conveniently. Each cageway connecting device can connect one upper cageway 2 and one lower cageway 7, so multiple cageways can be connected, and the notch is set at the top end of the lower cageway 7, so that the lower cageway 7 is convenient to insert into the cageway connecting device. The two first steel angles 103 can clamp the corresponding first cageway beam 3, so as to make each cageway connecting device be fixed on the corresponding first cageway beam 3, and further fix the upper cageway 2 and the lower cageway 7. In this way, it is convenient to adjust the installation position of the cageway connecting device, and then adjust the installation position of the upper and lower cageways. The fixed block 105, the pin boss 107 and the fixed pin 108 can fix the cageway connecting device and the lower cageway 7 to enhance the stability of the device and the lower cageway 7, and further the shim 5 and ribs 104 plate are able to strengthen the firmness and stability of the overall structure.

Moreover, the cageway connecting device of the present invention is independent of each cageway, and each cageway connecting device is set between the two cageways, therefore, the device can be installed and adjusted freely and accurately on the cageway beam. The position accuracy of the cageways is determined by multiple cageway connecting devices as a whole, which can improve the accuracy of the initial installation of the cageway and facilitate the replacement of the cageway.

Second Embodiment

A connecting method of a cageway connecting device is shown as an embodiment. The method is used for connecting an upper cageway 2 and a lower cageway 7, and a notch being set at the top end of the lower cageway 7. The cageway connecting device of this embodiment is the same as that of the first embodiment. The connecting method includes the following steps: (1) Fixing the two first steel angles 103 in the vertical direction, and putting the top end of the lower cageway 7 on the bottom end of the lower cannula 106, then rotating the lower cageway 7 to make the first pin bore and the second pin bore be coaxial; (2) Passing the bottom end of the fixed pin 108 through the first pin bore, then inserting the bottom end of the fixed pin 108 into the second pin bore to make the pin boss 107 and the fixed block 105 be fixed; and (3) Putting the bottom end of the upper cageway 2 on the top end of the upper cannula 101 to make upper cageway 2 be overlapped on the connecting cageway 102.

The connecting method can make each first cageway beam 3 bear the weight of the above cageway, so the first cageway beam 3 is determined and controllable, and the deformation of the first cageway beams 3 and the mutual extrusion of the cageways will not exist.

Third Embodiment

A connecting method of a cageway connecting device is shown as an embodiment. The method is used for connecting an upper cageway 2 and a lower cageway 7, and a notch being set at the top end of the lower cageway 7. The cageway connecting device of this embodiment is the same as that of the first embodiment. The connecting method includes the following steps.

(1) Pre assembling each cageway connecting device and the corresponding cageways. In this step, making one-to-one corresponding marks on each cageway connecting device and the corresponding cageways, and protecting the ends of the cageways.

(2) Clamping the first steel angles 103 of each cageway connecting device to the corresponding first cageway beam 3 to make each cageway connecting device be fixed on the corresponding first cageway beam 3. In this step, putting the top end of the lower cageway 7 on the bottom end of the corresponding lower cannula 106 by a bottom-up installation method.

(3) First, putting the top end of the lower cageway 7 on the bottom end of the lower cannula 106, then rotating the lower cageway 7 to make the first pin bore and the second pin bore be coaxial; second, passing the bottom end of the fixed pin 108 through the first pin bore, then inserting the bottom end of the fixed pin 108 into the second pin bore to make the pin boss 107 and the fixed block 105 be fixed; third, putting the bottom end of the upper cageway 2 on the top end of the upper cannula 101 to make upper cageway 2 be overlapped on the connecting cageway 102; the last, rotating the upper cageway 2, then fixing the upper cageway 2 through another cageway connecting device above the upper cageway 2, and installing each cageway according to this step to complete the connection of each cageway.

The connecting method can make each first cageway beam 3 bear the weight of the above cageway, so the first cageway beam 3 is determined and controllable, and the deformation of the first cageway beams 3 and the mutual extrusion of the cageways will not exist.

Fourth Embodiment

Figure 3:
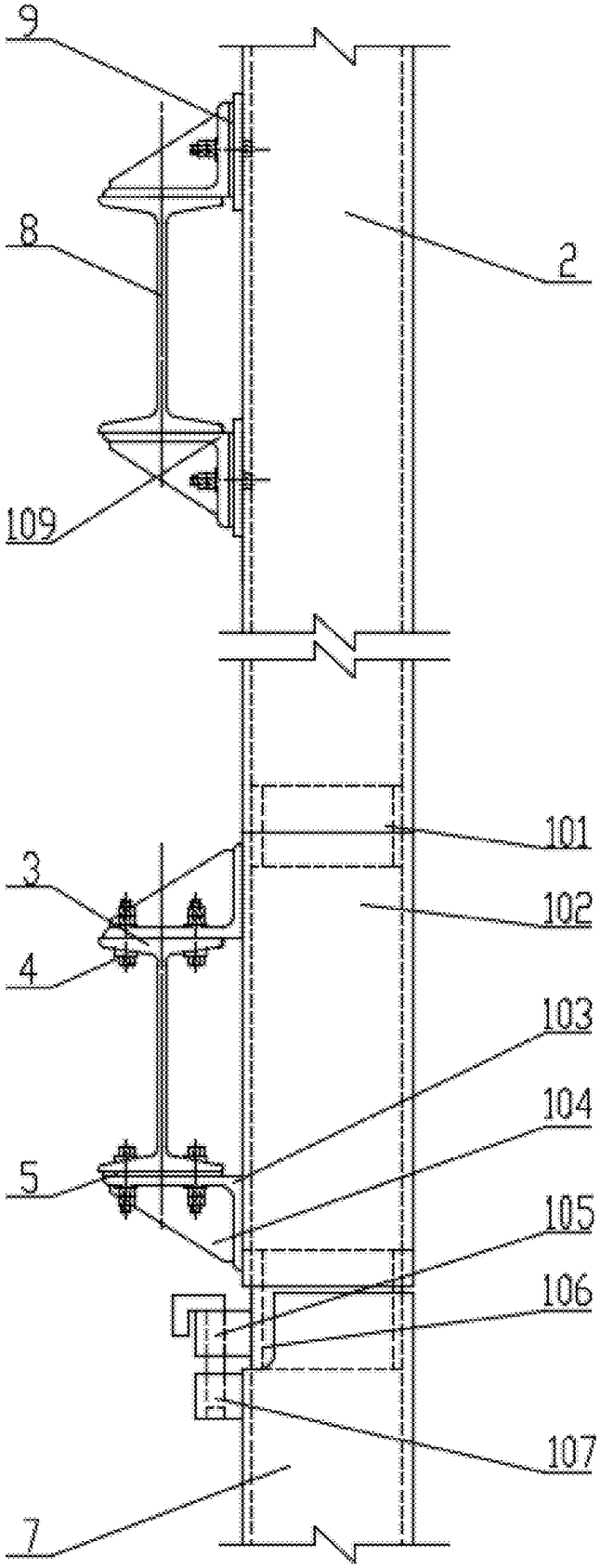
FIG. 3 is a connection diagram of the cageway connecting device and the upper cageway, according to the fourth embodiment of the present invention.
Figure 4:
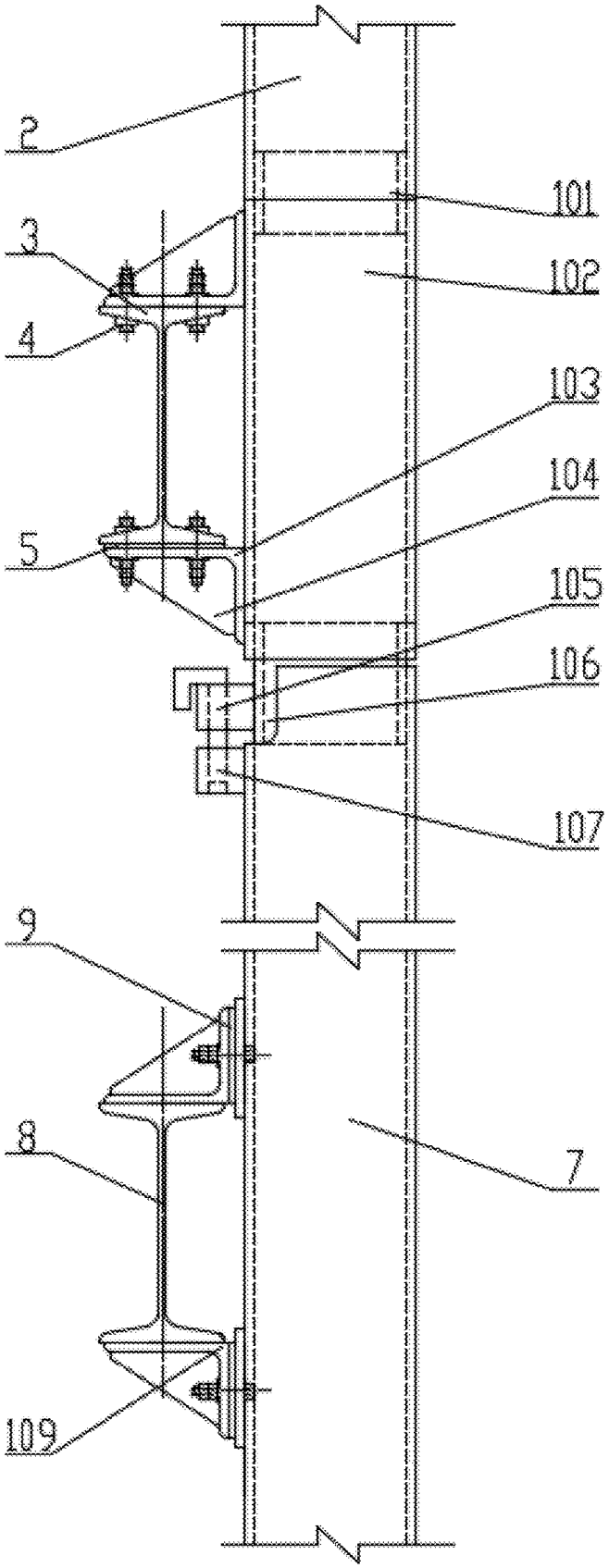
FIG. 4 is a connection diagram of the cageway connecting device and the lower cageway, according to the fourth embodiment of the present invention.

Referring to FIGS. 3 and 4, a cageway connecting device is shown as an embodiment. The cageway connecting device is similar to the device of the first embodiment, but the device of this embodiment adds an assist mechanism. The aassist mechanism includes two second steel angles 109 symmetrically arranged, further includes two backing boards 9 corresponding to the two second steel angles 109. The two second steel angles 109 are fixed on the same side of the upper cageway 2 or the lower cageway 7 and set from top to bottom. A second cageway beam 8 is set between the two second steel angles 109, and the two second steel angles 109 are fixed on the top and bottom ends of the second cageway beam 8 respectively. Each backing board is set between the corresponding second steel angle 109 and the upper cageway 2 or the lower cageway 7. In this embodiment, a rib 104 is also fixed on the bending surface of the second steel angles 109, so as to improve the stress stability of the second steel angles 109 and the firmness of the assist mechanism.

The assist mechanism further strengthens the stability of the upper cageway 2 and the lower cageway 7, prevents the offset of each cageway, and further improves the stability of the connection of the cageways. The fixed pin 108 can be a taper pin, its self-locking property is good, and the positioning accuracy is high, which is convenient for the installation of the cageway and the influence of multiple assembly and disassembly on the positioning accuracy is small. The fixed pin 108 can be a cylindrical pin, the shear resistance between the upper cageway 2 and the lower cageway 7 can be strengthened, and the stability of the connection of the cageways can be improved.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A cageway connecting device, for connecting an upper cageway and a lower cageway; a notch being set at the top end of the lower cageway; the cageway connecting device comprising:

a connecting cageway, being set between the upper cageway and the lower cageway;

an upper cannula, the bottom end of the upper cannula being fixed in the top end of the connecting cageway, the top end of the upper cannula being inserted into the bottom end of the upper cageway and conformed on the inner wall of the bottom end of the upper cageway;

a lower cannula, the top end of the lower cannula being fixed in the bottom end of the connecting cageway, the bottom end of the lower cannula being inserted into the top end of the lower cageway and conformed on the inner wall of the top end of the lower cageway;

two first steel angles symmetrically arranged, being fixed on the same side of the connecting cageway and set from top to bottom;

a fixed block, being fixed on the outside of the lower cannula, and a first pin bore downward being set in the fixed block;

a pin boss, being fixed on the outside of the top end of the lower cageway, and being located below the notch; a second pin bore coaxial with the first pin bore being set in the pin boss; and a fixed pin, for fixing the fixed block and the pin boss; the bottom end of the fixed pin being passed through the first pin bore and inserted into the second pin bore.

2. The cageway connecting device according to claim 1, wherein a first cageway beam being set between the two first steel angles, and the two first steel angles being fixed on the top and bottom ends of the first cageway beam respectively by a plurality of fasteners.

3. The cageway connecting device according to claim 2, wherein each first steel angle being fixed on the first cageway beam by two fasteners symmetrical about the first cageway beam.

4. The cageway connecting device according to claim 2, wherein the fasteners being bolts.

5. The cageway connecting device according to claim 2, wherein a shim being set between the first cageway beam and the first steel angle located below the first cageway beam.

6. The cageway connecting device according to claim 1, further comprising:

two ribs, corresponding to the two first steel angles respectively; each rib being fixed on the bending surface of the corresponding first steel angle.

7. The cageway connecting device according to claim 1, wherein the fixed pin being a taper pin or a cylindrical pin.

8. The cageway connecting device according to claim 1, further comprising:

an assist mechanism, comprising two second steel angles symmetrically arranged; the two second steel angles being fixed on the same side of the upper cageway or the lower cageway and set from top to bottom.

9. The cageway connecting device according to claim 8, wherein a second cageway beam being set between the two second steel angles, and the two second steel angles being fixed on the top and bottom ends of the second cageway beam respectively.

10. The cageway connecting device according to claim 8, wherein the assist mechanism further comprising two backing boards corresponding to the two second steel angles; each backing board being set between the corresponding second steel angle and the upper cageway or the lower cageway.

11. The cageway connecting device according to claim 1, wherein the cross section of the connecting cageway being the same as that of the upper cageway and the lower cageway.

12. A connecting method of a cageway connecting device, for connecting an upper cageway and a lower cageway; a notch being set at the top end of the lower cageway; the cageway connecting device comprising:

a connecting cageway, being set between the upper cageway and the lower cageway;

an upper cannula, the bottom end of the upper cannula being fixed in the top end of the connecting cageway, the top end of the upper cannula being inserted into the bottom end of the upper cageway and conformed on the inner wall of the bottom end of the upper cageway;

a lower cannula, the top end of the lower cannula being fixed in the bottom end of the connecting cageway, the bottom end of the lower cannula being inserted into the top end of the lower cageway and conformed on the inner wall of the top end of the lower cageway;

two first steel angles symmetrically arranged, being fixed on the same side of the connecting cageway and set from top to bottom;

a fixed block, being fixed on the outside of the lower cannula, and a first pin bore downward being set in the fixed block;

a pin boss, being fixed on the outside of the top end of the lower cageway, and being located below the notch; a second pin bore coaxial with the first pin bore being set in the pin boss; and a fixed pin, for fixing the fixed block and the pin boss; the bottom end of the fixed pin being passed through the first pin bore and inserted into the second pin bore;

the connecting method comprising:

fixing the two first steel angles in the vertical direction, and putting the top end of the lower cageway on the bottom end of the lower cannula, then rotating the lower cageway to make the first pin bore and the second pin bore be coaxial;

passing the bottom end of the fixed pin through the first pin bore, then inserting the bottom end of the fixed pin into the second pin bore to make the pin boss and the fixed block be fixed; and putting the bottom end of the upper cageway on the top end of the upper cannula to make upper cageway be overlapped on the connecting cageway.

13. A connecting method of a cageway connecting device, for connecting an upper cageway and a lower cageway; a notch being set at the top end of the lower cageway;

the cageway connecting device comprising:

a connecting cageway, being set between the upper cageway and the lower cageway;

an upper cannula, the bottom end of the upper cannula being fixed in the top end of the connecting cageway, the top end of the upper cannula being inserted into the bottom end of the upper cageway and conformed on the inner wall of the bottom end of the upper cageway;

a lower cannula, the top end of the lower cannula being fixed in the bottom end of the connecting cageway, the bottom end of the lower cannula being inserted into the top end of the lower cageway and conformed on the inner wall of the top end of the lower cageway;

two first steel angles symmetrically arranged, being fixed on the same side of the connecting cageway and set from top to bottom; a first cageway beam being set between the two first steel angles, and the two first steel angles being fixed on the top and bottom ends of the first cageway beam respectively by a plurality of fasteners;

a fixed block, being fixed on the outside of the lower cannula, and a first pin bore downward being set in the fixed block;

a pin boss, being fixed on the outside of the top end of the lower cageway, and being located below the notch; a second pin bore coaxial with the first pin bore being set in the pin boss; and a fixed pin, for fixing the fixed block and the pin boss; the bottom end of the fixed pin being passed through the first pin bore and inserted into the second pin bore;

the connecting method comprising:

(1) pre assembling each cageway connecting device and the corresponding cageways;

(2) clamping the first steel angles of each cageway connecting device to the corresponding first cageway beam to make each cageway connecting device be fixed on the corresponding first cageway beam; and (3) first, putting the top end of the lower cageway on the bottom end of the lower cannula, then rotating the lower cageway to make the first pin bore and the second pin bore be coaxial; second, passing the bottom end of the fixed pin through the first pin bore, then inserting the bottom end of the fixed pin into the second pin bore to make the pin boss and the fixed block be fixed; third, putting the bottom end of the upper cageway on the top end of the upper cannula to make upper cageway be overlapped on the connecting cageway; the last, rotating the upper cageway, then fixing the upper cageway through another cageway connecting device above the upper cageway, and installing each cageway according to this step to complete the connection of each cageway.

14. The connecting method according to claim 13, wherein in step (1), making one-to-one corresponding marks on each cageway connecting device and the corresponding cageways, and protecting the ends of the cageways.

15. The connecting method according to claim 13, wherein in step (3), putting the top end of the lower cageway on the bottom end of the corresponding lower cannula by a bottom-up installation method.

* * * * *